US005865370A

United States Patent [19]

Sonneville et al.

[11] Patent Number: 5,865,370

[45] Date of Patent: Feb. 2, 1999

[54] RAIL FASTENING SYSTEM FOR FASTENING A RAIL TO A RAIL SUPPORT AND ASSEMBLY INCLUDING SUCH RAIL FASTENING SYSTEM COUPLED TO THE RAIL SUPPORT

[75] Inventors: Roger P. Sonneville, Annapolis, Md.; Bernard Sonneville, Springfield, Va.; Anderson Thomas Bray, Jr., Silver Spring, Md.

[73] Assignee: Sonneville International Corporation, Alexandria, Va.

[21] Appl. No.: 870,449

[22] Filed: Jun. 6, 1997

[51] Int. Cl.[6] ..... E01B 9/00

[52] U.S. Cl. ..... 238/331; 238/333; 238/354; 238/351

[58] Field of Search ..... 238/310, 331, 238/333, 349, 351, 354, 361

[56] References Cited

U.S. PATENT DOCUMENTS

| | | | |
|---|---|---|---|
| 2,525,731 | 10/1950 | Schulze | 238/349 |
| 3,515,347 | 6/1970 | Waters et al. . | |
| 3,887,128 | 6/1975 | Ruble . | |
| 3,894,687 | 7/1975 | Jacobson . | |
| 3,970,248 | 7/1976 | Molyneux . | |
| 4,066,212 | 1/1978 | Sonnville . | |
| 4,312,477 | 1/1982 | Hixson . | |
| 4,373,667 | 2/1983 | Duchemin . | |
| 4,588,126 | 5/1986 | Foulart . | |
| 4,832,261 | 5/1989 | Fee . | |
| 4,981,264 | 1/1991 | Osasche et al. . | |
| 5,016,816 | 5/1991 | Lanham . | |
| 5,042,717 | 8/1991 | Vanotti . | |
| 5,125,573 | 6/1992 | Vanotti | 238/251 |
| 5,485,955 | 1/1996 | Owen . | |
| 5,520,330 | 5/1996 | Brown et al. . | |
| 5,566,882 | 10/1996 | Brown et al. . | |

FOREIGN PATENT DOCUMENTS

| | | | |
|---|---|---|---|
| 2107398 | 10/1971 | Germany | 238/349 |

OTHER PUBLICATIONS

UniP Tie Company, Inc., "UniP FASTENERS" brochure, Mar. 1997.

Pandrol Type PR Series Clip (no date).

*Primary Examiner*—Mark Tuan Le

*Attorney, Agent, or Firm*—Wenderoth, Lind & Ponack, L.L.P.

[57] ABSTRACT

A rail fastening system for fastening a rail to a rail support includes a frame member supported by the rail support and including an upper bracing portion positioned above the rail support to define therebetween a space. A stationary insulator member is positioned at a fixed location on the rail support. A plate-shaped spring blade has a first end resting on the stationary insulator member and an opposite second end supported by a movable insulator member. A wedge member is connected to the spring blade and is operable to be inserted into the space, thereby inserting the spring blade into the space with the first end of the spring blade being supported and sliding on the stationary insulator member and with the second end of the spring blade being supported on and moving the movable insulator member in the insertion direction. The wedge member is braced against the bracing portion of the frame member and causes the spring blade to deflect downwardly to press the opposite ends of the spring blade against the insulator members while the opposite ends of the spring blade are deflected or urged upwardly.

85 Claims, 7 Drawing Sheets

RAIL FASTENING SYSTEM FOR FASTENING A RAIL TO A RAIL SUPPORT AND ASSEMBLY INCLUDING SUCH RAIL FASTENING SYSTEM COUPLED TO THE RAIL SUPPORT

BACKGROUND OF THE INVENTION

The present invention is directed to a rail fastening system for fastening a rail to a rail support. The present invention particularly is directed to such a system for use in fastening a railroad rail to a rail support such as a concrete rail support, for example a concrete tie. The present invention also is directed to an assembly of such rail fastening system connected to a rail support.

It has become conventional in the industry to employ rail fasteners including ductile cast iron shoulder or support members fastened to rail supports, for example by being embedded in concrete ties. Such cast iron shoulders have proven ability to resist lateral forces transmitted by the foot of a rail as well as vertical forces exerted by various types of spring fastening clips.

One such system is disclosed in U.S. Pat. Nos. 5,520,330 and 5,566,882. Such known system employs fastening clips made of round steel that is bent to a shape such that it operates at the same time both in torsion and in flexion. Such combined stresses however are not recommended by some railroad engineers. Furthermore, the elastic range of the fastening and the actual toe load on the rail is limited. This system is employed primarily due to ease of installation and of tensioning of the spring clips.

Another known system is disclosed in U.S. Pat. No. 4,066,212. This system employs a threaded bolt that is embedded in a concrete tie. A flat plate-shaped spring steel clip is tensioned by a nut threaded onto the bolt such that one end of the spring steel clip is pressed downwardly against an elevated shoulder of the concrete tie and an opposite end of the steel spring clip is pressed downwardly against an insulating member interposed between a flange of a rail and the spring steel clip. The spring steel clip or spring blade has a relatively large hole in the center thereof for passage of the bolt. Such large hole can weaken the spring blade. Further, since tensioning is achieved by threading of the nut, or more recently by screws and inserts anchored in the concrete tie, the stressing of the spring blade is dependent on tightening torque and requires skilled workers and well adjusted power wrenches. Further, corrosion of the bolt threads creates maintenance difficulties. Nevertheless, such system, when employed properly, is desirable because of the use of the flat spring steel blade and the tensioning achieved thereby.

SUMMARY OF THE INVENTION

With the above discussion in mind, it is an object of the present invention to provide a rail fastening system for use in fastening a rail to a rail support wherein it is possible to employ the advantages of known systems and at the same time to eliminate disadvantages of such known systems.

It is a further object of the present invention to provide an assembly of such rail fastening system preliminarily assembled to a rail support, whereby such assembly can be stored or transported to a position of utilization and then used to fasten a rail to the rail support.

It is a still further object of the present invention to provide such a system and assembly that provides efficient tensioning without the use of threaded bolts and nuts.

It is an even further object of the present invention to provide such a system and assembly that employs a flat spring blade as a clip but at the same time employs a shoulder or frame member, thereby achieving the advantages of both such elements.

It is an even further object of the present invention to provide such a system and assembly that may be operated to fasten a rail to the rail support during which friction contact, particularly sliding contact, between the flat spring blade and any metal or abrasive member or material is avoided entirely.

It is a yet further object of the present invention to provide such a system and assembly that may be implemented easily without the use of skilled workers or sophisticated equipment.

It is a still yet further object of the present invention to provide such a system and assembly that provides resistance against lateral forces of the rail, sufficient tensioning of the rail, and electrical insulation of the rail.

The above objects are achieved in accordance with one aspect of the present invention by a rail fastening system for use in fastening a rail to a rail support. The above objects are achieved in accordance with another aspect of the present invention by the provision of an assembly including such rail fastening system assembled to a rail support and capable of being stored or transported to a position of utilization and then being operable to fasten a rail to the rail support.

The rail fastening system includes a shoulder or frame member to be supported by the rail support and including an upper bracing portion to be positioned above the rail support to define therebetween a space extending in an insertion direction that is transverse to a longitudinal direction of a rail to be fastened. The frame member further includes a base portion supported by the rail support and opposite lateral walls connecting the upper bracing portion to the base portion. The space is a tunnel shaped passage defined between the upper bracing portion, the lateral walls and the base portion. The frame member further may include at least one anchor member extending downwardly from the base portion to be embedded in the rail support when the rail support is in the form of a molded member, for example a concrete tie. The base portion, the lateral walls, the upper bracing portion and the anchor member are formed unitarily as a one-piece element from a suitable material, for example cast iron.

A stationary insulator member, formed of a suitable electrical insulating material, for example high viscosity polyamide, is supported at a fixed location on the rail support. The stationary member has first and second portions positioned at locations upstream and downstream, respectively, relative to the insertion direction. The first portion has an upper surface that is inclined downwardly in the insertion direction, and the second portion has an upper surface that is inclined upwardly in the insertion direction. A plate-shaped spring blade, for example formed of spring steel, has a first end resting on the upper surface of the first portion of the stationary insulator member. A movable insulator member supports a second end of the spring blade. A wedge member has a projection extending into a hole in the spring blade. The wedge member has an upper surface that is wedged against the upper bracing portion of the frame member and a lower curved surface in contact with the spring blade. The movable insulator member is positioned on the upper surface of the second portion of the stationary insulator member. The wedge member can be forced in the insertion direction such that the wedge member moves in the insertion direction, and due to the spring blade being connected to the wedge member, the spring blade is moved with the wedge member. This also moves the movable insulator member. Opposite ends of the spring blade are supported by the stationary and movable insulator members such that during this movement there is no friction contact between the spring blade and any metal or abrasive members or material. As the wedge member and spring blade are moved in the insertion direction, the wedge member is braced against the upper bracing portion of the frame member and the spring blade thus is deflected downwardly in the middle portion of the spring blade. One end of the spring blade is pressed downwardly against the stationary insulator member, while the opposite end of the spring blade is deflected upwardly and therefore exerts a downward pressure against the movable insulator member. The movable insulator member presses downwardly against the second portion of the stationary insulator member during a preliminary preassembly position of the fastening system to the rail support. Further insertion of the wedge member and the spring blade in the insertion direction causes the movable insulator member to move along an upper surface of a rail that is to be fastened.

High performance synthetic and insulating materials, such as high viscosity polyamide, of the stationary and movable insulator members are able to resist the lateral forces of the rail against the frame member as well as the toe load exerted by the spring blade against the flange or foot of the rail. Such materials of the insulator members, combined with the use of a conventionally elastomeric rail pad, provide electrical insulation of the rail.

The only portion of the system that extends upwardly from a concrete tie employed as the rail support includes the upper bracing portion and opposite lateral legs of the frame member. Thus, the concrete tie can be made with a flat upper surface, except for such sole protruding portion.

Since the only activity that is required to employ the system to fasten the rail to the rail support is the insertion of the wedge member, assembly can be achieved without skilled workers and without sophisticated equipment. For example, the wedge member simply can be inserted by use of a hammer. When the wedge member, spring blade and movable insulator member are partially inserted, the spring blade is sufficiently tensioned to maintain such elements in position on the main insulator member. This allows the rail fastening system to be preassembled on the rail support. Such assembly then can be later installed at a position of utilization without dismantling the rail fastening system.

The movable insulator member includes a bottom ramp portion that acts as a wedge to bend the forward end of the spring blade upwardly during the final phase of installation whereat the movable insulator member moves upwardly along the foot or flange of the rail. The movable insulator member is provided with a rim that acts as a guide between the lateral walls of the frame member and that supports the leading end of the spring blade to improve electrical insulation. The movable insulator member includes a thin portion extending rearwardly from the forward ramp portion to reinforce guidance of the spring blade between the lateral walls of the frame member, thus providing resistance against rail creep. Such thin portion avoids contact with the stationary insulator member even when the rail is heavily loaded and the system is highly compressed.

The stationary insulator member rests on the horizontal plane of the concrete support and/or the cast iron base portion of the frame member, rather than forming a permanent concrete protrusion extending above the rail seat level as in prior art systems. The direct contact between the spring blade and the abrasive concrete shoulder of the prior art system is avoided.

The dimensions and materials of the various elements of the system are suitably chosen for a particular application and installation to achieve a desired tensioning and fastening force. Particularly, such dimensions and materials are chosen to provide a flexing of the spring blade to achieve a desired curvature thereof at a desired radius to ensure that the spring blade never is understressed or overstressed. The protrusion extending from the curved bottom surface of the wedge member fits into a hole in the spring blade enabling the spring blade to be introduced into and retrieved from the space within the frame member without any friction between the spring blade and the wedge member or between the spring blade and the frame member. Such friction would otherwise abrade the spring blade or any applied corrosion resistance coating thereof, and reduce the fatigue life and/or durability of the spring blade. The friction between the spring blade and the stationary insulator member and the movable insulator member does not cause abrasion of the spring blade due to the insulating material of the insulator members.

BRIEF DESCRIPTION OF THE DRAWINGS

Other objects, features and advantages of the present invention will become apparent from a consideration of the following detailed description of a preferred embodiment of the invention, with reference to the accompanying drawings, wherein.

DETAILED DESCRIPTION OF THE INVENTION

Figure 1:
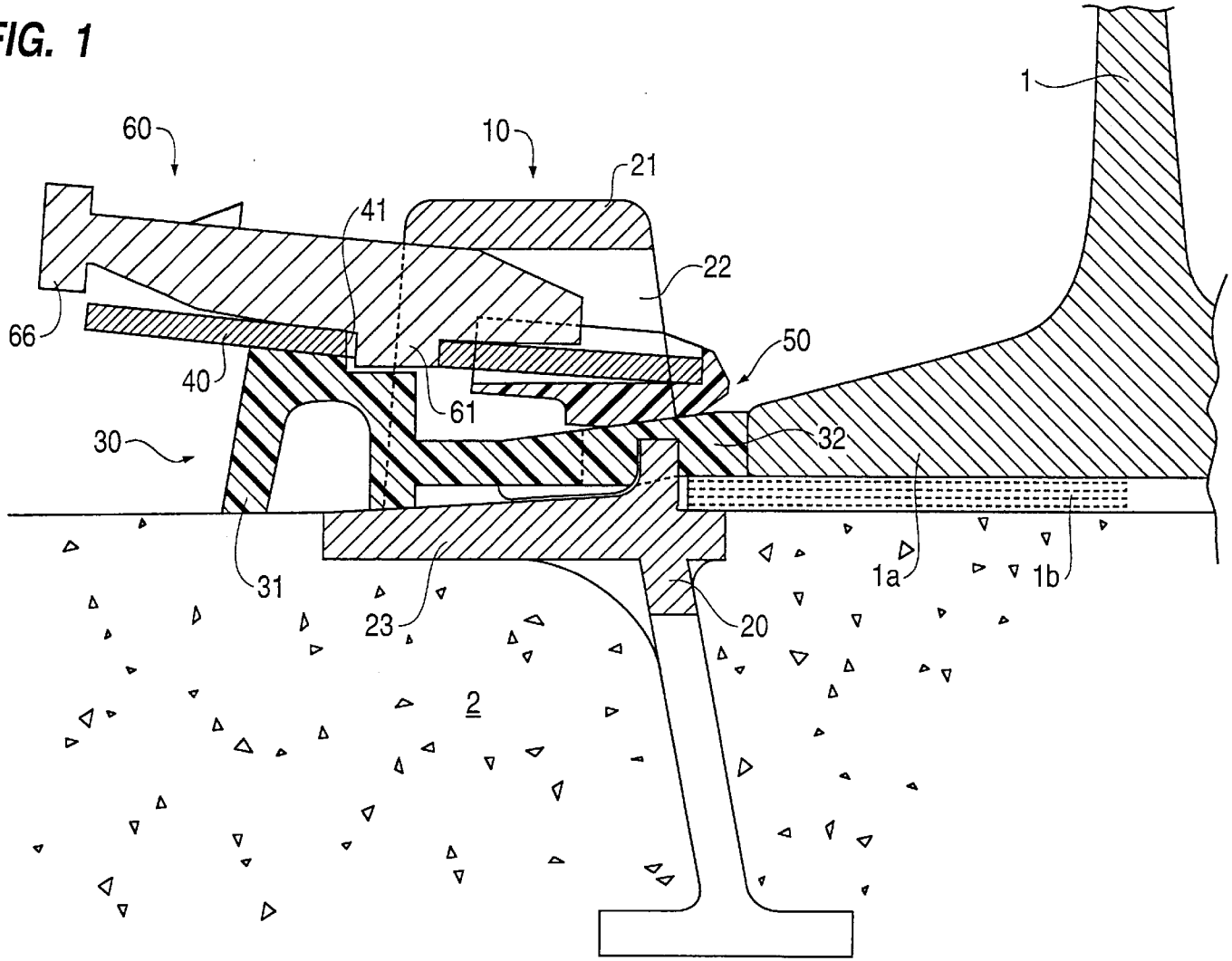
FIG. 1 is a cross sectional view of a rail fastening system shown connected to a rail support and about to be moved to a position fastening a rail to the rail support.
Figure 2:
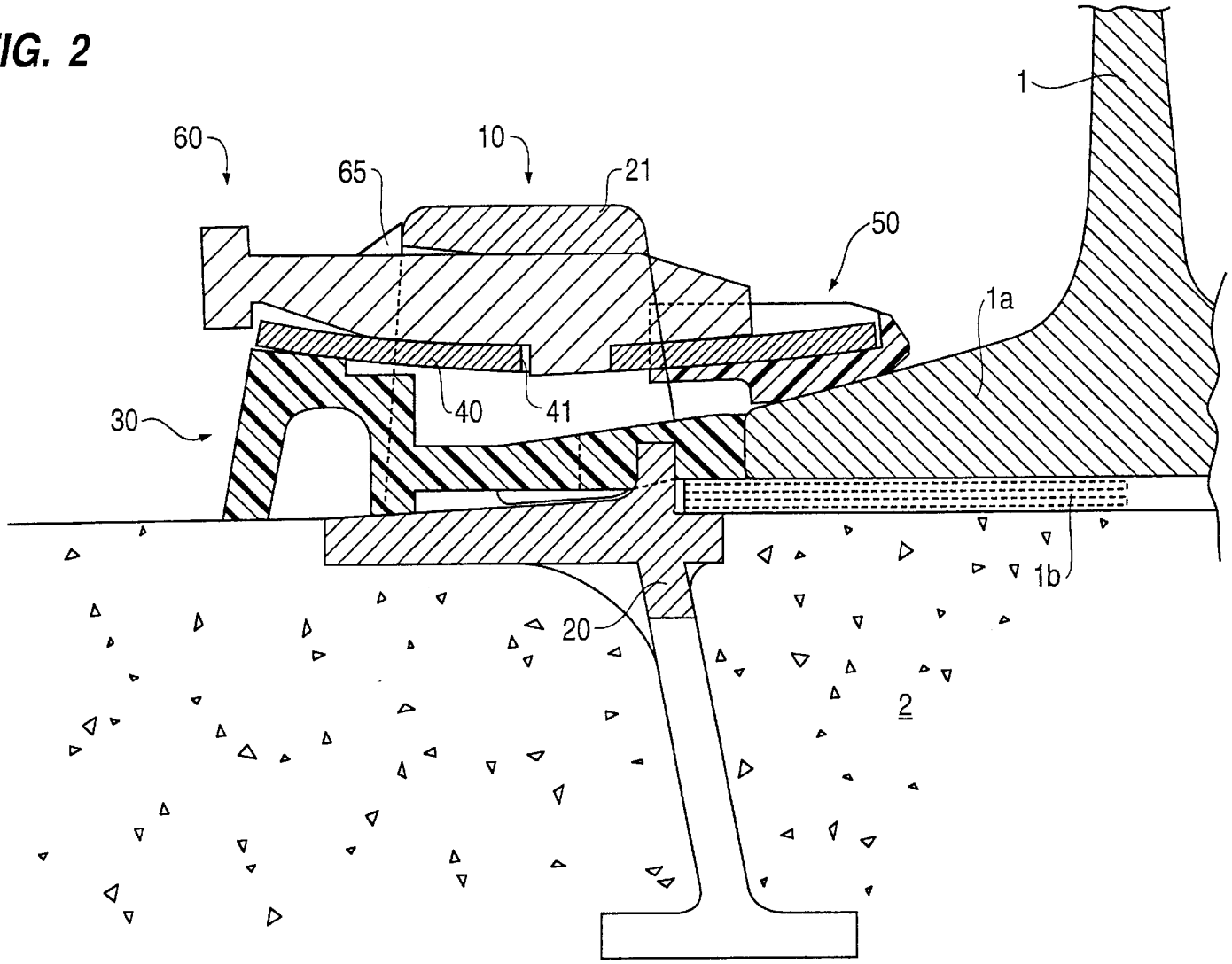
FIG. 2 is a view similar to FIG. 1 but showing the rail fastening system in an operative position fastening the rail to the rail support.

FIGS. 1 and 2 illustrate different positions of utilization of a rail fastening system 10 in accordance with the present invention for fastening a rail 1 to a rail support 2. It is contemplated that the rail 1 with which the rail fastening system of the invention is employable may include any type of conventional rail generally having a rail foot or flanges 1*a* (only one of which is shown in FIGS. 1 and 2). It is contemplated that the rail support 2 may be any type of known rail support such as a tie. It is contemplated that the present invention particularly is useful with a concrete tie, which is intended to be illustrated in FIGS. 1 and 2.

The rail fastening system 10 includes a frame member 20 to be supported by rail support 2 and including an upper bracing portion 21 to be positioned above rail support 2 to define therebetween a space 22 that extends in an insertion direction that is to be transverse to a longitudinal direction of rail 1. The insertion direction is from the left to the right as viewed in FIGS. 1 and 2, the longitudinal direction of the rail being understood to be perpendicular to the plane of FIGS. 1 and 2. The rail fastening system further includes a stationary insulator member 30 to be positioned at a fixed location on rail support 2, a plate-shaped spring blade 40 having a first end adapted to rest on stationary insulator member 30 and an opposite second end. The first end of spring blade 40 is the left end as viewed in FIGS. 1 and 2, and the second end of spring blade 40 is the right end as viewed in FIGS. 1 and 2. The rail fastening system further includes a movable insulator member 50 that supports the second end of spring blade 40. The rail fastening system additionally includes a wedge member 60 that can be connected to spring blade 40. Wedge member 60 is operable to cooperate with the upper bracing portion 21 of frame member 20, with stationary insulator member 30 and with movable insulator member 50 to insert spring blade 40 into space 22 and to deflect spring blade 40 generally downwardly as viewed in FIGS. 1 and 2 at a portion between the first and second ends thereof. As a result, the first end of spring blade 40 is pressed against stationary insulator member 30, and the second end of the spring blade 40 and the movable insulator member 50 are pressed downwardly. During this insertion movement in the insertion direction, there is no frictional sliding movement between the spring blade and any metal or abrasive members or materials. This feature will be discussed in more detail below.

FIG. 1 shows the rail fastening system in a preliminarily positioned or assembled condition whereat the frame member 20 is embedded in concrete tie 2 and wherein elements 30, 40, 50 and 60 are assembled together in a condition such that the concrete tie and thus assembled rail fastening system may be handled or shipped as a unit. FIG. 1 also illustrates such unit positioned adjacent to the rail 1 resting on an insulating rail pad 1*b* in preparation to further insert the wedge member 60, the spring blade 40 and the movable insulator member 50 to the position shown in FIG. 2, whereat the rail 1 is fastened to the concrete tie 2 by the rail fastening system 10.

Figure 3:
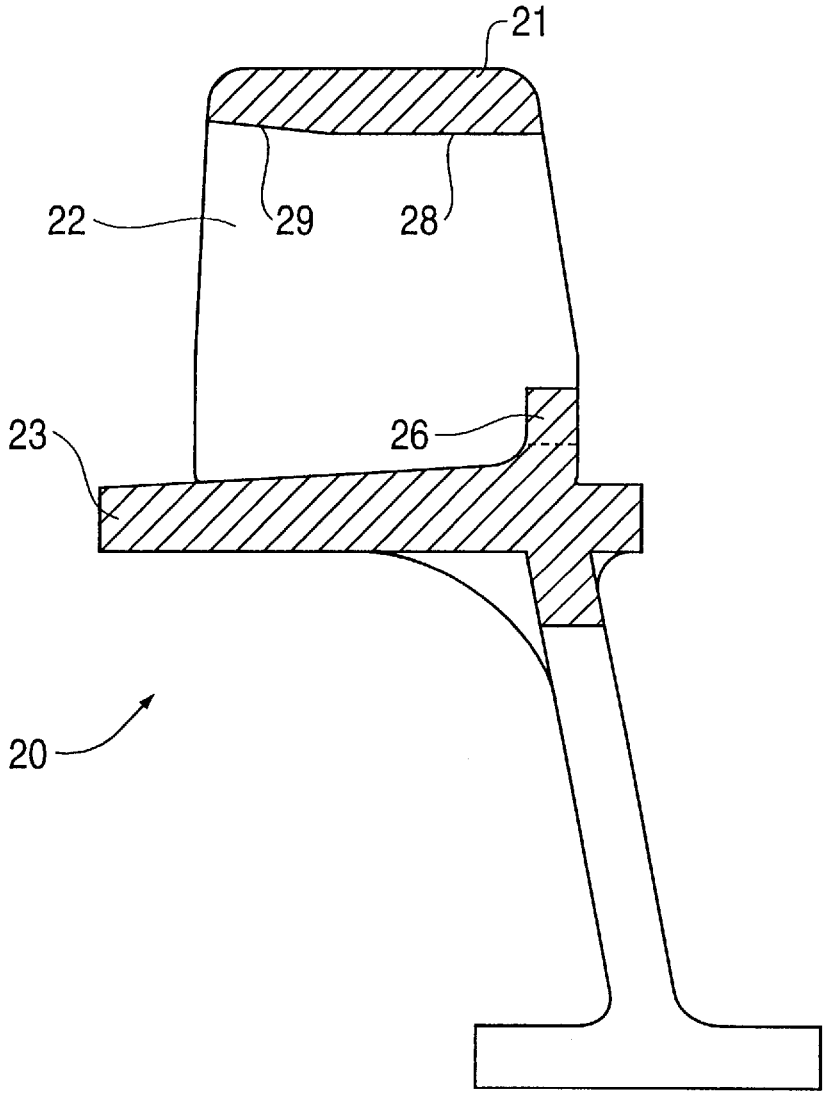
FIG. 3 is a sectional view of a frame member of the rail fastening system.
Figure 4:
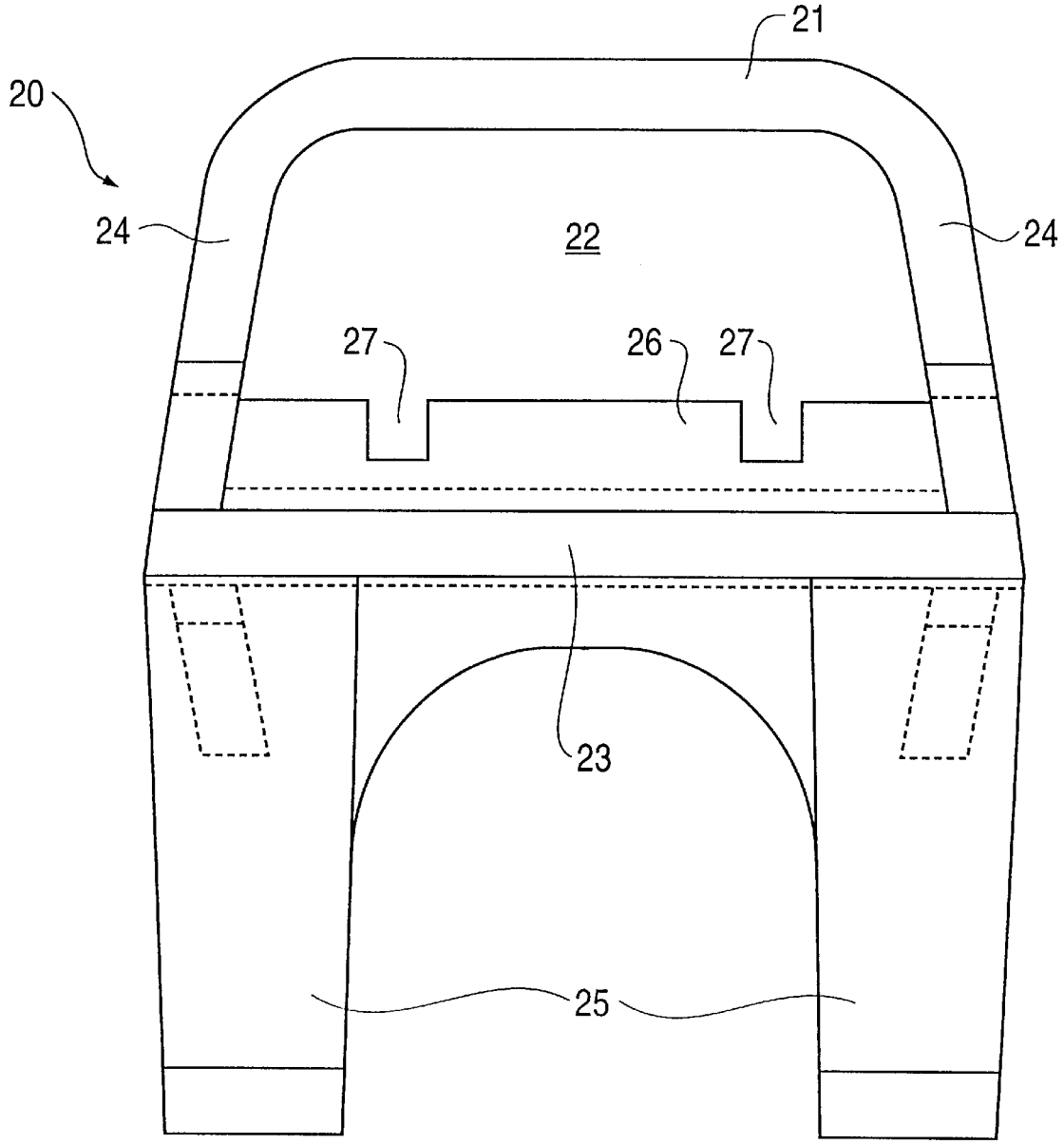
FIG. 4 is an end view thereof.

Frame member 20 is shown in more detail in FIGS. 3 and 4. Thus, frame member 20 further includes a base portion 23 connected to upper bracing portion 21 by opposite lateral walls 24. Space 22 thus is formed as a tunnel-shaped passage defined by upper bracing portion 21, lateral walls 24 and base portion 23. The frame member is intended to be connected to the rail support. In the particularly illustrated embodiment, the frame member includes structure to enable the frame member to be fixed to the rail support, and such structure is in the form of anchor members 25 extending downwardly from base portion 23 to be embedded in the rail support. As indicated above, the rail support illustrated in FIGS. 1 and 2 is in the form of a concrete tie, and anchor members 25 are embedded in such concrete tie. Frame member 20 further includes a cross member 26 extending upwardly from base portion 23. Cross member 26 has formed in an upper edge thereof grooves 27 into which fit flanges 36 of the stationary insulator member 30 (to be discussed in more detail below). Also, cross member 26 extends upwardly into a groove 35 formed in a lower portion of stationary insulator member 30 (as also to be discussed in more detail below). A spacing between the inside surfaces of lateral walls 24 is slightly greater than a dimension of stationary insulator member 30 in the longitudinal direction of the rail. This dimension of stationary insulator member 30 is the dimension thereof vertically in FIG. 6. The upper bracing portion 21 of frame 20 includes a lower surface that is abutted by a surface of wedge member 60. This lower surface of bracing portion 21 includes a main surface portion 28 that is planar and that extends generally horizontally and a beveled surface portion 29 that is inclined upwardly from an upstream end of main surface portion 28 relative to the insertion direction. Surfaces 28 and 29 will be discussed in more detail below relative to their cooperation with wedge member 60. The entire frame member 20 including upper bracing portion 21, base portion 23, lateral walls 24, anchors 25 and cross member 26, are formed together as a unitary, one-piece element from a suitable material, for example cast iron.

Figure 5:
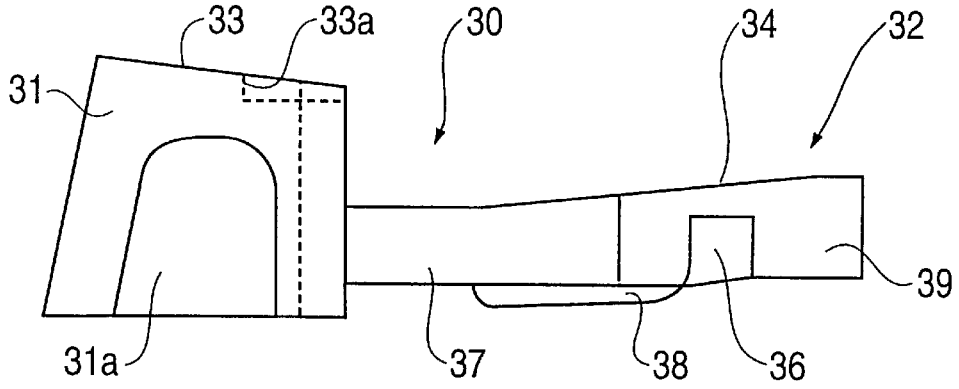
FIG. 5 is a side view of a stationary insulator member of the rail fastening system.
Figure 6:
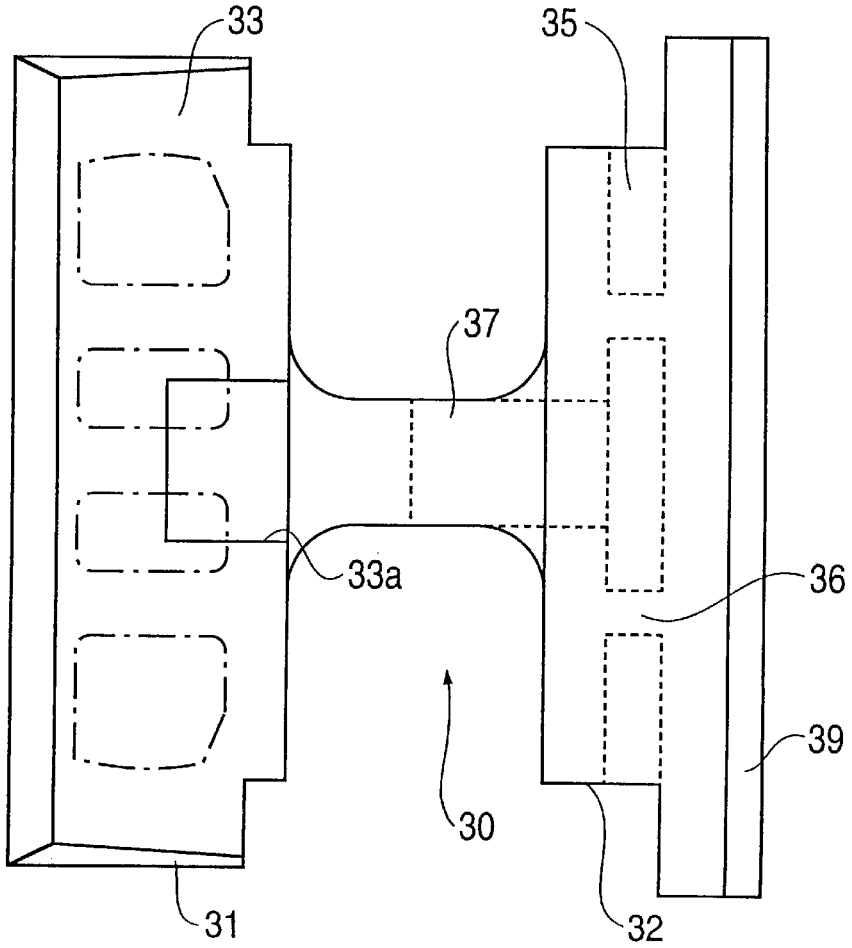
FIG. 6 is a plan view thereof.

The stationary insulator member 30, particularly shown in FIGS. 5 and 6, is formed of a suitable electrically insulating material, for example a high viscosity polyamide. Stationary insulator member 30, in accordance with the illustrated preferred embodiment, includes a first portion 31 and a second portion 32 adapted to be positioned respectively at locations upstream and downstream relative to the insertion direction. First portion 31 has an upper surface 33 that is inclined downwardly in the insertion direction. The first end of spring blade 40 rests on surface 33. Second portion 32 has an upper surface 34 that is inclined upwardly in the insertion direction. Movable insulator member 50 slides against upwardly inclined surface 34 during insertion of the spring blade 40 and the movable insulator member 50 in the insertion direction. The first and second portions 31, 32 are joined unitarily by a thin connecting portion 37, and all such elements are formed as a one-piece element. The second portion 32 includes a supporting part 38 having a bottom configured to be supported on base portion 23 of the frame member 20 and a rail-confronting part 39 adapted to be positioned to confront an edge of flange 1*a* of rail 1 (as shown in FIGS. 1 and 2). The supporting part 38 and the rail-confronting part 39 are separated and unitarily joined by the groove 35 into which extend unitarily formed flanges 36, discussed above. The first portion 31 may have formed therein voids or cavities 31*a* to reduce weight and to make molding easier and less expensive. Upper surface 33 has formed in a downstream or leading end thereof relative to the insertion direction a recess 33*a* dimensioned to receive a leading part of projection 61 of wedge member 60.

The plate-shaped spring blade 40 is formed of a suitable spring material, for example spring steel, and has therethrough a hole 41 dimensioned to receive projection 61, to be discussed in more detail below, of wedge member 60. This connects the wedge member to the spring blade.

Figure 7:
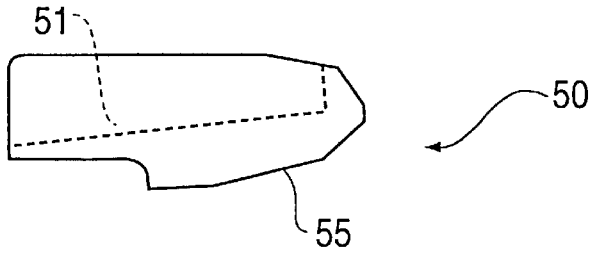
FIG. 7 is a side view of a movable insulator member of the rail fastening system.
Figure 8:
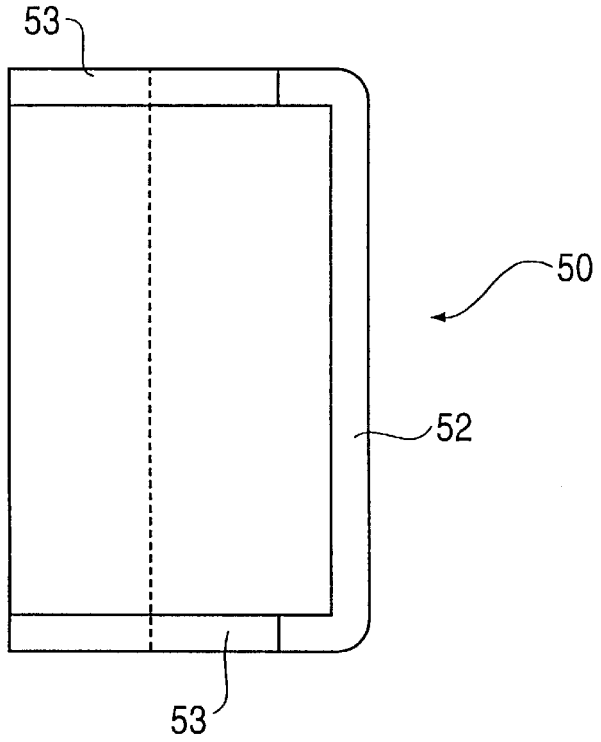
FIG. 8 is a plan view thereof.
Figure 9:
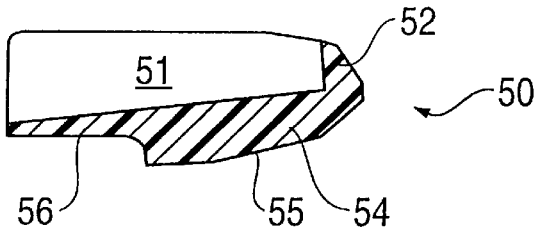
FIG. 9 is a sectional view thereof.

The movable insulator member 50, particularly shown in FIGS. 7–9, is formed of a suitable electrically insulating material, for example high viscosity polyamide. Movable insulator member 50 has therein a recess 51 dimensioned to receive the second end of spring blade 40. Recess 51 is open upwardly and has an open upstream side relative to the insertion direction, i.e. the left side as viewed in FIGS. 1, 2 and 7–9. Movable insulator member 50 has a downstream side and opposite lateral sides that are closed by an upwardly extending rim formed unitarily with the movable insulator member 50. The rim particularly is shown in FIGS. 7–9 and includes a forward or downstream side rim portion 52 and opposite lateral side rim portions 53. The dimension of movable insulator member 50 between outer surfaces of the lateral walls or rim portions 53 is slightly less than a dimension of space 22 in the longitudinal direction of the rail. Movable insulator member 50 includes a bottom ramp portion 54 having a bottom surface 55 that is inclined upwardly in the insertion direction. Movable insulator member 50 further includes a thin portion 56 extending in a direction that is upstream relative to the insertion direction from the bottom ramp portion 54 and that has a bottom surface at a level above the bottom surface 55 of bottom ramp portion 54.

Figure 10:
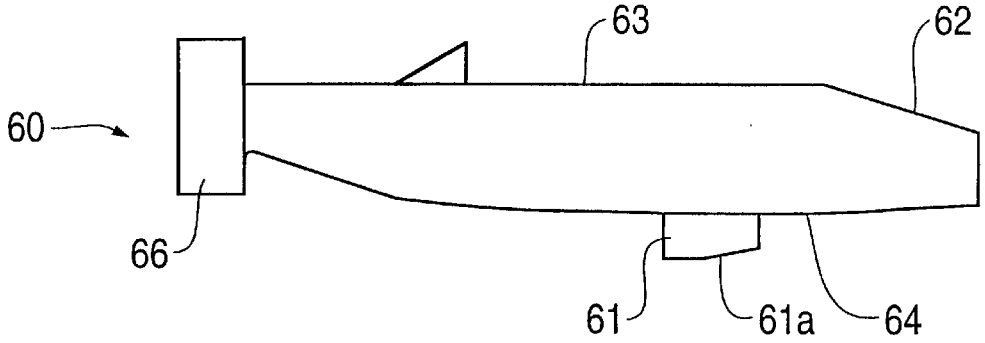
FIG. 10 is a side view of a wedge member of the rail fastening system.
Figure 11:
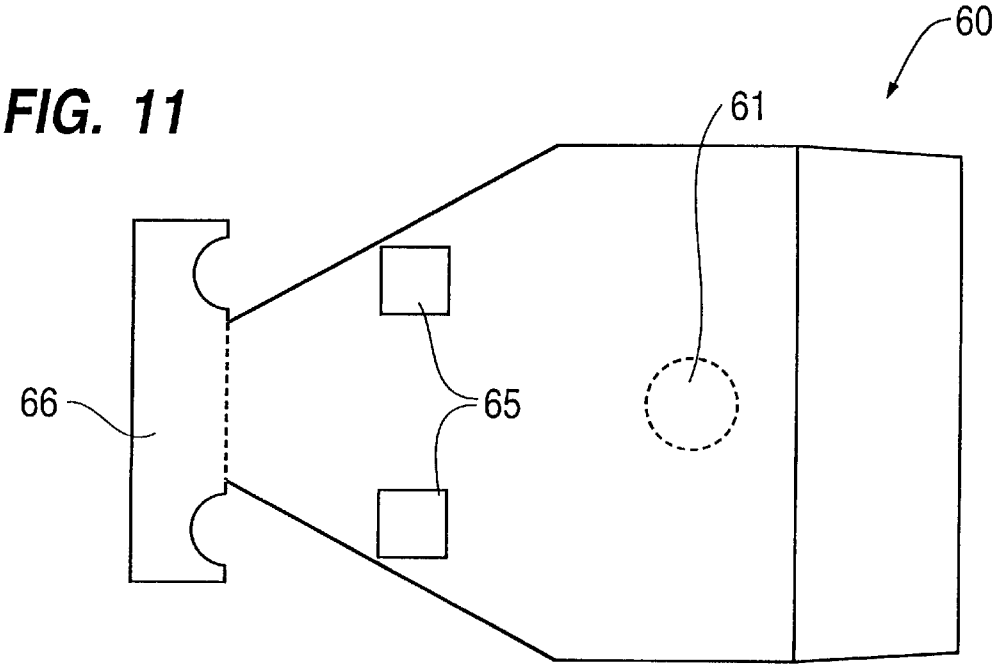
FIG. 11 is a plan view thereof.

The wedge member 60, particularly shown in FIGS. 10 and 11, includes a leading end, i.e. the right end as shown in the drawings, and a trailing end. A first surface of wedge member 60 is an upper surface thereof that includes a beveled surface portion 62 that is inclined upwardly and rearwardly at the leading end of the wedge member relative to the insertion direction. The upper surface of the wedge member further includes a main surface portion 63 extending rearwardly from the beveled surface portion 62 relative to the insertion direction. Wedge member 60 further includes a second or lower surface 64 that is a convex, smoothly curved surface. Projection 61 extends from surface 64 and fits within the hole 41 in spring blade 40. Projection 61 has an outer or lower surface 61*a* that is beveled upwardly and forwardly.

When the wedge member is inserted from the left with regard to FIG. 1, beveled surface portion 62 cooperates with the beveled surface portion 29 of upper bracing portion 21 of frame member 20 to facilitate insertion of the wedge member. Further insertion of the wedge member 60 enables a leading portion of main surface portion 63 of wedge member 60 to abut beveled surface portion 29. This results in a preliminary assembled condition of members 20, 30, 40, 50 and 60, as shown in FIG. 1. This preassembled condition enables such members to be stored and shipped while assembled to the rail support 2. When the rail fastening system then is to be assembled or fastened to rail 1, the rail pad 1*b* and rail 1 are positioned as shown in FIG. 1. Further insertion of the wedge member in the insertion direction results in the members being in the position shown in FIG. 2. At this position, the main surface portion 63 of the wedge member abuts the main surface portion 28 of the upper bracing portion 21 of frame member 20. At this position also the movable insulator member 50 has moved from the surface 34 of the stationary insulator member 30 onto the upper surface of the flange 1*a* of the rail 1. Wedge member 60 is braced against upper bracing portion 21, and this causes, during movement from the position of FIG. 1 to the position of FIG. 2, deflection of the longitudinally middle portion of the spring blade 40. The resiliency of the spring blade 40 causes the opposite longitudinal ends of the spring blade to be pressed downwardly. The first or trailing end of the spring blade is pressed downwardly against surface 33 of the stationary insulator member 30. The second or leading end of the spring blade is bent upwardly by being forced to move along surface 34 and the surface of flange 1*a*. Thus, the second end of the spring blade is pressed downwardly against movable insulator member 50, thereby pressing movable insulator member 50 against flange 1*a* of rail 1. In the preliminary assembled position of FIG. 1, the trailing end of projection 61 fits within recess 33*a* at the forward end of surface 33 of stationary insulator member 30. Extending upwardly from the main surface portion 63 are a pair of abutment projections 65 that abut the trailing edge of the upper bracing portion 21 to limit the extent of insertion of wedge member 60 in the insertion direction, as shown in FIG. 2.

It will be apparent that, as the wedge member and spring blade are inserted in the insertion direction, there is no moving or friction contact between the spring blade and any metal or abrasive members or materials. This improves insulation and also avoids damage to the spring blade.

Wedge member 60 further includes at the trailing end thereof relative to the insertion direction suitable structure 66 operable to cooperate with a tool to enable the wedge member to be inserted or retracted relative to the insertion direction. The wedge member 60 has a dimension in the longitudinal direction of the rail, i.e. the vertical direction in FIG. 11, that is slightly less than a dimension of the space 22 in such direction.

Although the present invention has been described and illustrated with respect to a preferred embodiment thereof, it is to be understood that such description and illustration are intended to be illustrative of the invention only and not limiting thereto. For example, the present invention is not limited to a concrete tie 2 as illustrated, with the frame member 20 being embedded in such concrete tie. The frame member of the present invention could be otherwise attached to a concrete tie or to any other type of rail support. For example, the frame member could be attached to a plate or could have an integral plate that is attached to any type of known rail support.

The various described elements will have dimensions and be formed of suitable materials, presently known and to be developed in the future, within the concept of the present invention to achieve the desired and described rail fastening function. Such materials and sizes will depend on a given rail installation, and such materials and sizes could be varied and adjusted in accordance with the requirements for a particular installation in manners that would readily be understood by one of ordinary skill in the art from the present disclosure. Accordingly, it is contemplated that all such parameters and all modifications and changes to the specifically described and illustrated structures that would be apparent to one of ordinary skill in the art from the present disclosure are intended to be within the scope of the present invention as embodied by the appended claims.

We claim:

1. A rail fastening system for use in fastening a rail to a rail support, said fastening system comprising:

a frame member to be supported by the rail support and including an upper bracing portion adapted to be positioned above the rail support to define therebetween a space extending in an insertion direction to be transverse to a longitudinal direction of the rail;

a stationary insulator member adapted to be positioned at a fixed location on the rail support;

a plate-shaped spring blade having a first end to rest on said stationary insulator member and an opposite second end;

a movable insulator member positionable to support said second end of said spring blade; and a wedge member connectable to said spring blade and operable to, with said second end of said spring blade being supported by said movable insulator member and with said spring blade resting on said stationary insulator member, insert said spring blade into said space and move said spring blade and said movable insulator member in said insertion direction to be toward the rail, said wedge member having a first surface to be wedged against said upper bracing portion of said frame member during such movement and a second surface that deflects said spring blade downwardly at a portion thereof between said first and second ends thereof, thereby pressing said first end of said spring blade against said stationary insulator member and pressing said second end of said spring blade and said movable insulator member in a direction to be toward a flange of the rail.

2. A rail fastening system as claimed in claim 1, wherein said frame member further includes a base portion to be supported by the rail support.

3. A rail fastening system as claimed in claim 2, wherein said frame member further includes opposite lateral walls connecting said upper bracing portion to said base portion.

4. A rail fastening system as claimed in claim 3, wherein said space comprises a tunnel-shaped passage defined by said upper bracing portion, said lateral walls and said base portion.

5. A rail fastening system as claimed in claim 3, wherein said upper bracing portion, said lateral walls and said base portion are formed together from the same material as a unitary, one-piece element.

6. A rail fastening system as claimed in claim 5, wherein said material comprises cast iron.

7. A rail fastening system as claimed in claim 3, wherein said frame member further includes structure to enable said frame member to be fixed to the rail support.

8. A rail fastening system as claimed in claim 7, wherein said structure comprises at least one anchor member extending downwardly from said base portion and adapted to be embedded in the rail support.

9. A rail fastening system as claimed in claim 8, wherein said at least one anchor member is formed unitarily with said base portion, said lateral walls and said bracing portion as a one-piece element.

10. A rail fastening system as claimed in claim 3, further comprising a cross member projecting upwardly from said base portion and extending between and joined to said lateral walls.

11. A rail fastening system as claimed in claim 10, wherein said cross member has formed in an upper edge thereof at least one groove adapted to receive a flange of said stationary insulator member.

12. A rail fastening system as claimed in claim 3, wherein a spacing between said lateral walls is slightly greater than a dimension of said stationary insulator member in the longitudinal direction of the rail.

13. A rail fastening system as claimed in claim 1, wherein said bracing portion includes a lower surface to be abutted by said first surface of said wedge member.

14. A rail fastening system as claimed in claim 13, wherein said lower surface of said bracing portion includes a main surface portion that is planar and that extends generally horizontally and a beveled surface portion that is inclined upwardly from an upstream end of said main surface portion relative to said insertion direction.

15. A rail fastening system as claimed in claim 1, wherein said stationary insulator member is formed of an electrically insulating material.

16. A rail fastening system as claimed in claim 15, wherein said material comprises high viscosity polyamide.

17. A rail fastening system as claimed in claim 1, wherein said stationary insulator member includes first and second portions adapted to be positioned respectively at locations upstream and downstream relative to said insertion direction, said first portion having an upper surface that is inclined downwardly in said insertion direction and on which is to rest said first end of said spring blade, and said second portion having an upper surface that is inclined upwardly in said insertion direction and against which slides said movable insulator member during movement thereof in said insertion direction.

18. A rail fastening system as claimed in claim 17, wherein said first and second portions are formed together from electrically insulating material as a unitary one-piece element.

19. A rail fastening system as claimed in claim 17, wherein said first and second portions are joined unitarily by a thin connecting portion.

20. A rail fastening system as claimed in claim 17, wherein said second portion includes a supporting part having a bottom configured to be supported on a base portion of said frame member and a rail-confronting part adapted to be positioned to confront an edge of the flange of the rail.

21. A rail fastening system as claimed in claim 20, wherein said second portion has a bottom having formed therein a groove separating said supporting part and said rail-confronting part and defining a thin connecting part that unitarily joins said supporting part and said rail-confronting part.

22. A rail fastening system as claimed in claim 21, wherein said groove is dimensioned to receive a cross member extending upwardly from said base portion of said frame member.

23. A rail fastening system as claimed in claim 22, wherein said second portion further includes at least one flange extending into said groove and dimensioned to be received in a groove formed in an upper edge of said cross member.

24. A rail fastening system as claimed in claim 20, wherein said rail-confronting part has a substantially horizontal lower surface.

25. A rail fastening system as claimed in claim 17, wherein said upper surface of said first portion has formed therein, at least in a downstream end thereof relative to said insertion direction, a recess dimensioned to receive part of a projection extending from said wedge member.

26. A rail fastening system as claimed in claim 25, wherein said recess is open at a downstream side thereof and has an upstream side defined by a step in said first portion.

27. A rail fastening system as claimed in claim 1, wherein said spring blade has formed therein a hole dimensioned to receive a projection extending from said wedge member, thereby enabling connection of said wedge member and said spring blade and to allow movement thereof in said insertion direction.

28. A rail fastening system as claimed in claim 1, wherein said movable insulator member is formed of an electrically insulating material.

29. A rail fastening system as claimed in claim 28, wherein said material comprises high viscosity polyamide.

30. A rail fastening system as claimed in claim 1, wherein said movable insulator member has therein a recess dimensioned to receive said second end of said spring blade.

31. A rail fastening system as claimed in claim 30, wherein said recess is open upwardly, has an open upstream side relative to said insertion direction, and has a downstream side and opposite lateral sides closed by an upwardly extending rim formed unitarily with said movable insulator member.

32. A rail fastening system as claimed in claim 31, wherein a dimension of said movable insulator member between outer surfaces of lateral walls of said rim is slightly less than a dimension of said space in the longitudinal direction of the rail.

33. A rail fastening system as claimed in claim 1, wherein said movable insulator member includes a bottom ramp portion having a bottom surface adapted to be directed toward the flange of the rail.

34. A rail fastening system as claimed in claim 33, wherein said bottom surface is inclined upwardly in said insertion direction.

35. A rail fastening system as claimed in claim 34, wherein said movable insulator member further includes a thin portion extending upstream from said bottom ramp portion relative to said insertion direction and having a bottom surface at a level above said bottom surface of said bottom ramp portion.

36. A rail fastening system as claimed in claim 1, wherein said first surface of said wedge member comprises an upper surface thereof and includes a beveled surface portion that is inclined upwardly at a leading end of said wedge member relative to said insertion direction and a main surface portion extending rearwardly from said beveled surface portion relative to said insertion direction.

37. A rail fastening system as claimed in claim 36, wherein said wedge member further includes an abutment projection operable to abut said frame member to limit movement of said wedge member in said insertion direction.

38. A rail fastening system as claimed in claim 37, wherein said abutment projection extends from said upper surface of said wedge member.

39. A rail fastening system as claimed in claim 1, wherein said second surface of said wedge member comprises a lower surface thereof.

40. A rail fastening system as claimed in claim 39, wherein said lower surface of said wedge member is a convex, smoothly curved surface.

41. A rail fastening system as claimed in claim 1, wherein said wedge member further includes a projection extending from said second surface and dimensioned to fit within a hole formed in said spring blade.

42. A rail fastening system as claimed in claim 41, wherein said projection has an end surface that is inclined toward said second surface in said insertion direction.

43. A rail fastening system as claimed in claim 1, wherein said wedge member further includes, at a trailing end thereof relative to said insertion direction, structure operable to cooperate with a tool for imparting insertion or retraction movement to said wedge member.

44. A rail fastening system as claimed in claim 1, wherein said wedge member has a dimension in the longitudinal direction of the rail that is slightly less than a dimension of said space in the longitudinal direction of the rail.

45. An assembly comprising a rail support adapted to support thereon a rail, and a rail fastening system adapted to fasten the rail to said rail support, said rail fastening system comprising:

a frame member fixed to said rail support and including an upper bracing portion positioned above said rail support and defining therebetween a space extending in an insertion direction to be transverse to a longitudinal direction of the rail;

a stationary insulator member positioned at a fixed location on said rail support;

a plate-shaped spring blade having a first end resting on said stationary insulator member and an opposite second end;

a movable insulator member positioned to support said second end of said spring blade; and a wedge member having a first surface wedged against said upper bracing portion of said frame member and a second surface pressing said spring blade toward said rail support, thereby pressing said first end of said spring blade against said stationary insulator member and pressing said second end of said spring blade and said movable insulator member in a direction to press said movable insulator member against said stationary insulator member.

46. An assembly as claimed in claim 45, wherein said frame member further includes a base portion supported by said rail support.

47. An assembly as claimed in claim 46, wherein said frame member further includes opposite lateral walls connecting said upper bracing portion to said base portion.

48. An assembly as claimed in claim 47, wherein said space comprises a tunnel-shaped passage defined by said upper bracing portion, said lateral walls and said base portion.

49. An assembly as claimed in claim 47, wherein said rail support comprises a concrete tie, and said base portion of said frame member has extending therefrom at least one anchor member embedded in said concrete tie.

50. An assembly as claimed in claim 49, wherein said at least one anchor member is formed unitarily with said base portion, said lateral walls and said bracing portion of the same material as a one-piece element.

51. An assembly as claimed in claim 50, wherein said material comprises cast iron.

52. An assembly as claimed in claim 47, further comprising a cross member projecting upwardly from said base portion and extending between and joined to said lateral walls.

53. An assembly as claimed in claim 52, wherein said cross member has formed in an upper edge thereof at least one groove receiving a flange of said stationary insulator member.

54. An assembly as claimed in claim 47, wherein a spacing between said lateral walls is slightly greater than a dimension of said stationary insulator member in the longitudinal direction of the rail.

55. An assembly as claimed in claim 45, wherein said bracing portion includes a lower surface abutted by said first surface of said wedge member.

56. An assembly as claimed in claim 55, wherein said lower surface of said bracing portion includes a main surface portion that is planar and that extends generally horizontally and a beveled surface portion that is inclined upwardly from an upstream end of said main surface portion relative to said insertion direction.

57. An assembly as claimed in claim 45, wherein said stationary insulator member is formed of an electrically insulating material.

58. An assembly as claimed in claim 57, wherein said material comprises high viscosity polyamide.

59. An assembly as claimed in claim 45, wherein said stationary insulator member includes first and second portions positioned respectively at locations upstream and downstream relative to said insertion direction, said first portion having an upper surface that is inclined downwardly in said insertion direction and against which is pressed said first end of said spring blade, and said second portion having an upper surface that is inclined upwardly in said insertion direction and against which is pressed said movable insulator member.

60. An assembly as claimed in claim 59, wherein said first and second portions are formed together from electrically insulating material as a unitary one-piece element.

61. An assembly as claimed in claim 59, wherein said first and second portions are joined unitarily by a thin connecting portion.

62. An assembly as claimed in claim 59, wherein said second portion includes a supporting part having a bottom supported on a base portion of said frame member and a rail-confronting part adapted to be positioned to confront an edge of the flange of the rail.

63. An assembly as claimed in claim 62, wherein said second portion has a bottom having formed therein a groove separating said supporting part and said rail-confronting part and defining a thin connecting part that unitarily joins said supporting part and said rail-confronting part.

64. An assembly as claimed in claim 63, wherein said groove receives a cross member extending upwardly from said base portion of said frame member.

65. An assembly as claimed in claim 64, wherein said second portion further includes at least one flange extending into said groove and received in a groove formed in an upper edge of said cross member.

66. An assembly as claimed in claim 62, wherein said rail-confronting part has a substantially horizontal lower surface.

67. An assembly as claimed in claim 59, wherein said upper surface of said first portion has formed therein, at least in a downstream end thereof relative to said insertion direction, a recess receiving part of a projection extending from said wedge member.

68. An assembly as claimed in claim 67, wherein said recess is open at a downstream side thereof and has an upstream side defined by a step in said first portion.

69. An assembly as claimed in claim 45, wherein said spring blade has formed therein a hole receiving a projection extending from said wedge member.

70. An assembly as claimed in claim 45, wherein said movable insulator member is formed of an electrically insulating material.

71. An assembly as claimed in claim 70, wherein said material comprises high viscosity polyamide.

72. An assembly as claimed in claim 45, wherein said movable insulator member has therein a recess receiving said second end of said spring blade.

73. An assembly as claimed in claim 72, wherein said recess is open upwardly, has an open upstream side relative to said insertion direction, and has a downstream side and opposite lateral sides closed by an upwardly extending rim formed unitarily with said movable insulator member.

74. An assembly as claimed in claim 73, wherein a dimension of said movable insulator member between outer surfaces of lateral walls of said rim is slightly less than a dimension of said space in the longitudinal direction of the rail.

75. An assembly as claimed in claim 45, wherein said movable insulator member includes a bottom ramp portion having a bottom surface that is inclined upwardly in said insertion direction.

76. An assembly as claimed in claim 75, wherein said movable insulator member further includes a thin portion extending upstream from said bottom ramp portion relative to said insertion direction and having a bottom surface at a level above said bottom surface of said bottom ramp portion.

77. An assembly as claimed in claim 45, wherein said first surface of said wedge member comprises an upper surface thereof and includes a beveled surface portion that is inclined upwardly at a leading end of said wedge member relative to said insertion direction and a main surface portion extending rearwardly from said beveled surface portion relative to said insertion direction.

78. An assembly as claimed in claim 77, wherein said wedge member further includes an abutment projection abutting said frame member.

79. An assembly as claimed in claim 78, wherein said abutment projection extends from said upper surface of said wedge member.

80. An assembly as claimed in claim 45, wherein said second surface of said wedge member comprises a lower surface thereof.

81. An assembly as claimed in claim 80, wherein said lower surface of said wedge member is a convex, smoothly curved surface.

82. An assembly as claimed in claim 45, wherein said wedge member further includes a projection extending from said second surface and fitting within a hole formed in said spring blade.

83. An assembly as claimed in claim 82, wherein said projection has an end surface that is inclined toward said second surface in said insertion direction.

84. An assembly as claimed in claim 45, wherein said wedge member further includes, at a trailing end thereof relative to said insertion direction, structure operable to cooperate with a tool for imparting insertion or retraction movement to said wedge member.

85. An assembly as claimed in claim 45, wherein said wedge member has a dimension in the longitudinal direction of the rail that is slightly less than a dimension of said space in the longitudinal direction of the rail.

* * * * *